US006244551B1

(12) United States Patent
Fletcher

(10) Patent No.: US 6,244,551 B1
(45) **Date of Patent: *Jun. 12, 2001**

(54) LADDER SECURING DEVICE FOR GUTTERS

(76) Inventor: J. Michael Fletcher, 1144 Fernwood Ave., Maple Shade, NJ (US) 08052

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/396,860

(22) Filed: Sep. 15, 1999

(51) Int. Cl.[7] ..... A47G 29/02; E04G 3/08; E06B 7/28; E04D 13/00

(52) U.S. Cl. ..... 248/238; 52/11

(58) Field of Search ..... 248/238, 210, 248/211; 52/11, 12; 182/120, 83, 84, 85

(56) References Cited

U.S. PATENT DOCUMENTS

| | | | | |
|---|---|---|---|---|
| 3,915,418 | * | 10/1975 | D'Amato | 52/11 |
| 4,185,421 | * | 1/1980 | Robinson | 52/11 |
| 4,272,370 | * | 6/1981 | Cunning | 52/12 |
| 4,331,217 | * | 5/1982 | Stecklow | 248/238 |
| 4,369,860 | * | 1/1983 | Beane | 248/210 |
| 4,601,365 | * | 7/1986 | Davis | 248/210 |
| 4,813,515 | * | 3/1989 | Wigington | 182/214 |
| 4,823,912 | * | 4/1989 | Gould et al. | 248/210 |
| 5,169,098 | * | 12/1992 | Samuelson | 248/48.2 |
| 5,358,071 | * | 10/1994 | Stennett | 182/214 |
| 5,497,848 | * | 3/1996 | Travis | 182/107 |
| 5,509,500 | * | 4/1996 | Delagera | 182/107 |
| 5,628,381 | * | 5/1997 | Maerkovich et al. | 248/210 |
| 5,911,659 | * | 6/1999 | Serano | 52/12 |
| 5,971,100 | * | 10/1999 | DeLeon et al. | 182/107 |
| 6,000,497 | * | 12/1999 | Kain et al. | 248/238 |

* cited by examiner

*Primary Examiner*—Ramon O. Ramirez
*Assistant Examiner*—J. DeLuca
(74) *Attorney, Agent, or Firm*—Dann Dorfman Herrell and Skillman, P.C.

(57) ABSTRACT

A ladder securing device fits within a gutter protruding from the eaves of a house. The device is made of members generally at right angles to each other. The members are elongated and board-like. A generally vertically oriented member extends lengthwise along the gutter with one edge on the bottom. A horizontal member is supported at the level of the top of the lip of the front wall of the gutter. Preferably the horizontal member extends well beyond the lip with a recess formed in the edge back almost to the gutter. The recess is preferably rectangular and long enough to accommodate the width of a ladder. If the gutter is a conventional flat bottom vertical back structure, the vertical member and the horizontal member merge at their edges in a simple right angle shape with the vertical member resting against the back wall. If the gutter does not have a vertical back wall the vertical member is positioned to rest at the low point of the gutter and preferably the horizontal member extends back to the back wall and has a stop member lengthwise to hold unitary structure against slippage beyond the back wall.

1 Claim, 1 Drawing Sheet

LADDER SECURING DEVICE FOR GUTTERS

BACKGROUND OF THE INVENTION

Rain gutters which protrude from the roofline of house roofs are subject to damage when ladders are placed against them, particularly when workmen climb up and down the ladders carrying heavy loads. In particular, the gutters are distorted in shape and/or squeezed together so that they no longer function as effectively or efficiently as intended. In some cases joints between sections of gutters may be broken so that the gutters leak and it is even possible in extreme cases for the gutters themselves to leak, particularly if left in their distorted position because paint and other protective coating tends to be cracked or broken off, leaving bare metal exposed to corrosion, such as rust, which may leak through the sheet-metal leaving a hole.

Even if the gutters are still functioning, the damage to the gutters destroys their appearance and disrupts the smooth lines of the house at roof level.

As a result of these problems various solutions have been proposed. One of the solutions is to provide extensions transverse to the ladder which may be bolted to the ladder temporarily when it is to be used with a roof having a protruding gutter. The extensions are designed to rest against the shingles of the roof, thus keeping the ladders spaced away from the gutter itself. The disadvantage of devices of this sort occurs because the individual pieces have to be carefully attached to the ladder sides and must be moved in some cases when the height of the roof changes. Some workers are uncomfortable with a ladder spaced away from a roof by extensions. Extensions themselves may do damage to certain types of shingles. The pre-attachment of the extension may also make it difficult to place the ladder both against the roof and on the ground particularly where the ground is suitable for supporting the ladder only in limited locations.

THE NATURE OF THE PRESENT INVENTION

The present invention is directed to a ladder securing device that fits into and is supported by a rain gutter. The device itself is very simple having two essentially board like members fixed together at a generally a right angle or "L" shape configuration. One member is vertically oriented to essentially the depth of the gutter so that its bottom rests against the gutter and supports the other member at the level of the gutter lip. The vertical member also is preferably arranged to rest against the back of the gutter to distribute forces imposed by a ladder leaning against and supported by the device on the horizontal member over the back lateral surfaces of the vertical member to a corresponding area of the gutter back wall. The horizontal member extends out over the front lip of the gutter, which therefore aids in maintaining proper orientation of the device during use. The horizontal member has a cutout portion from the edge that extends beyond the gutter. This cutout portion needs to be as wide as the maximum width of any ladder to be used and no deeper than where the edge of the front lip of the gutter can be seen. The horizontal member is held in place by the vertical member, on another downward extension of the horizontal member which rests against the back of the gutter. Holes for tie attachments may be provided so that ties can secure the device to the ladder if desired. It may be desirable to have the vertical member extend beyond the ends of the horizontal member to provide more area for support. In some instances users may wish to use screws through the back member, the gutter back wall and the supporting eaves for greater stability. Providing vertical support beyond the ends of the horizontal support gives a less obstructed area for screws.

More specifically, the present invention provides a ladder securing unitary sized to fit gutters within a particular range of dimensions, said device; device having first and second elongated members joined together along at least part of an elongated edge of one of said members in the direction of elongation of the other so that said members are generally oriented at right angles to one another. When the first member rests on the bottom of a gutter, the second member will rest atop the front lip of the gutter and extend beyond said lip away from the first member. The second member is longer than the ladder is broad and is provided with at least one recess from its outer edge extending inward toward but not as far as the gutter lip to accommodate the ladder side rails. The recess provides lateral shoulders to limit the lateral movement of the ladder side rails. At least one of said members provides a lengthwise extending stop member to engage at least a part of the inside surface of the back wall of the gutter to hold the unitary device against slippage toward or beyond the back wall.

DRAWINGS

Figure 2:
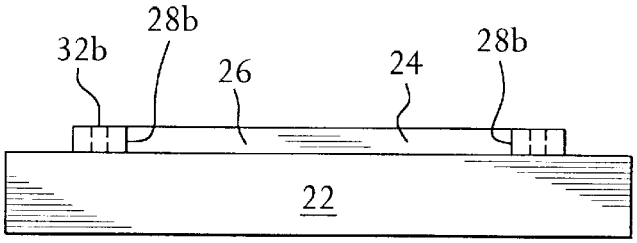
FIG. 2 is a front elevational view of the device of FIG.
Figure 3:
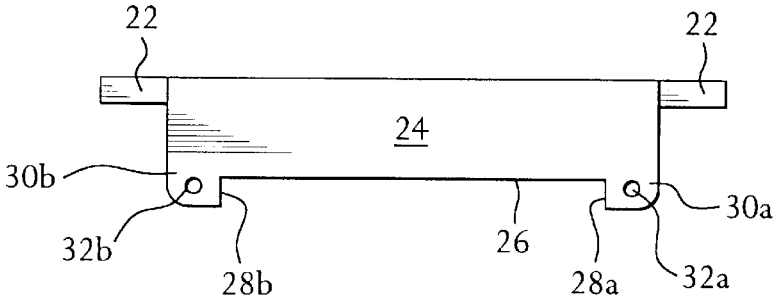

FIG. 3 planned view of the device of FIG. 2 from above.

Figure 4:
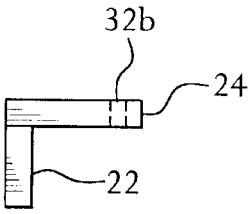

FIG. 4 is an end view of the device of FIG. 2 as viewed from the left end of FIG. 2.

DETAILED DESCRIPTION OF THE PRESENT INVENTION

Figure 1:
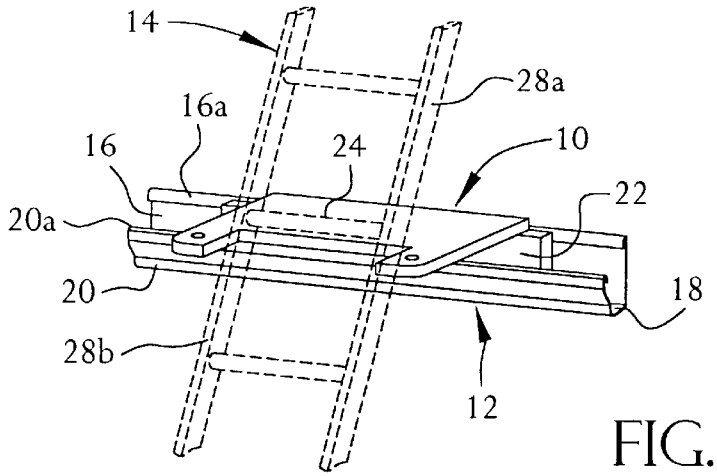
FIG. 1 is a perspective view showing a preferred device of the invention for securing a ladder positioned in a gutter with a section of the ladder shown in phantom.

FIG. 1 shows the ladder securing device generally designated 10 positioned in gutter 12 to hold a ladder 14 only partially shown in phantom. The gutter 16 is depicted as a sheet-metal structure bent to have a generally U shaped cross section. The invention is applicable to other shapes and materials for house gutters having support at the edge of the eaves. Typically, such a gutter is provided a with a planer, generally vertical back having a top edge provided by a strip 16*a* folded back into the gutter and against itself. The bottom 18 is a horizontal portion folded to a horizontal position generally perpendicular to the back. The front wall of the gutter 20 may be curved or formed into a multi-faceted bent wall terminated at its top edge in a lip 20*a* arranged horizontally adjacent the sidewall and a terminating vertical strip formed like the rest of the gutter by bending the very end of the narrow sheet forming the gutter into a vertical portion.

In its simplest form the ladder securing device 10 is comprised of a pair of members 22 and 24 secured to one another at essentially right angles as seen in FIGS. 2–4. The structure in it's simplest form may be composed of wooden boards nailed or otherwise secured together. Preferably, however, the device may be molded from appropriate resinous material, typically a filled polyester such as polyvinylchloride, polyurethane or polycarbonate to provide a relatively rigid one piece device. The vertical member 22 may be an elongated rectangular solid having a height corresponding to the depth of the gutter 16. Its length is determined by the nature of the gutter and should be shorter than the distance between supports for the gutter, or other obstructions. Where the back wall of the gutter 16 has a vertical back wall, the back face of member 22 then rests against that back wall with its bottom edge resting on the bottom 18 of the gutter. In such a situation, member 22 provides support for member 24 at the same height as the front lip 20 of the gutter. Member 24 in its simplest form is also a rectangular solid and may have a length somewhat shorter than member 22. Greater length provides access to the ends of member 22 through which screws can, if desired, be driven through the back of the gutter into the eaves or other supporting structure to hold the ladder support device even more firmly in place. The width of member 24 preferably extends well beyond the lip 20*a*. In its simplest forms, as illustrated in the drawing, a rectangular cutout is provided back no further than the vertical part of the lip 20*a* of the gutter. Thus the cutout provides a supporting edge 26 against which the ladder may be rested as shown in FIG. 1. Siderails 28*a* and 28*b* of the widest ladder determine the maximum lengthwise dimension of cutout and ends of the cutout act as lateral stops 28*a* and 28*b* or shoulders. Stops 28*a* and 28*b* are preferably the inside edges of extensions 30*a* and 30*b*, both constituting part of member 24. Alternatively, extensions should be separate pieces attached to member 24. Holes 32*a* and 32*b* may be provided vertically through extensions 30*a* and 30*b* to facilitate accommodation of rope for tying a ladder in place. Other means of fixing ladder siderails, such as a bar across the outside of the ladder to hold it within the recess of member 24, may alternatively be used. It is also possible to provide extensions by use of heavy bolts or other additions to a horizontal member 24 modified to terminate just beyond the gutter lip as stops for the ladder siderails.

In practice the ladder securing device is easily placed within a gutter from a ladder. In the type of gutter illustrated, the device will easily assume a natural position against the back wall of the gutter and the force applied by the ladder to the device will tend to secure its position. In practice some structural modification may be necessary if the back part of the gutter is not flat and vertical. What is needed is a stop on one member or the other to rest against the back wall of the gutter near the top to prevent movement of the ladder supporting edge backwards. For example, a modified vertical member would possibly be moved somewhat forward relative to the horizontal member so that it may extend generally vertically upward from the flat or slightly curved bottom of the gutter. One possibility for a stop is to provide member 24 with one or more downward extensions into the gutter so that they can bear the lateral forces imposed by the ladder against member 24, a single lengthwise extension slightly inwardly stepped edge from the bottom of member 24 will aid in indexing the device within the gutter.

Other structural modifications may be needed with gutters of somewhat different shapes but in each case the device provides an upward extending support essentially perpendicular to the supported horizontal member. The horizontal member is generally in the horizontal plane of the top of the lip at the front of the gutter.

Other changes, such as possibly providing individual recesses for the legs or struts of the ladder rather than the single recess, will occur to those skilled in the art. All such modifications within the scope of the claims are intended to be within the scope and spirit of the present invention.

I claim:

1. A ladder securing unitary device for gutters having a flat bottom, a generally vertical back wall and a lip having inner and outer top surfaces comprising:

a unitary device having only first and second elongated members joined together along at least part of an elongated edge of one of said members in the direction of elongation of the other, so that the first elongated member is longer than the second in the direction of elongation, is horizontally narrower than the width of the second member, so as not to fully obstruct the gutter in the direction of elongation when placed loosely in the gutter, and has a back surface conforming to a back gutter wall against which it is intended to rest, and so that said members form a rigid unitary molded construction device with its members generally oriented at right angles to one another and dimensioned for use with gutters of such size that when the first member is generally vertically oriented and rests on the bottom of a gutter during use, its back face lies essentially against the back wall of the gutter providing a large area of frictional contact, and the second generally horizontally disposed member will lie atop the front lip of the gutter, without contacting the inner and outer surfaces of the gutter lip, which tends to hold the unitary device in position to receive a ladder and so that the second member extends beyond said lip away from the first member, the second member being longer than the ladder used with the device is broad and being provided with at least one recess from its outer edge inward toward, but not as far as the gutter lip, when the first vertical member rests against the back of the gutter so that the recess accommodates the ladder side rails and provides lateral shoulders to limit lateral movement of the ladder side rails while the force of the ladder toward the gutter urges the first vertical member from a loosely fitting position into one in which the conforming surface is in frictional contact with the back wall of the gutter to hold the unitary device and the ladder in place while holding the ladder from further movement toward the gutter so that the ladder cannot contact the gutter.

* * * * *